US006315221B1

(12) United States Patent
Goenka et al.

(10) Patent No.: US 6,315,221 B1
(45) Date of Patent: Nov. 13, 2001

(54) NOZZLE

(75) Inventors: Lakhi Nandial Goenka, Ann Arbor; Marc Alan Straub, Dearborn Heights, both of MI (US)

(73) Assignee: Visteon Global Tech., Inc., Dearborn, MI (US)

( * ) Notice: Subject to any disclaimer, the term of this patent is extended or adjusted under 35 U.S.C. 154(b) by 0 days.

(21) Appl. No.: 09/470,137

(22) Filed: Dec. 22, 1999

(51) Int. Cl.[7] ..... B05B 1/00; F23D 14/48

(52) U.S. Cl. ..... 239/589; 239/553; 239/553.3; 239/553.5; 239/552; 239/566; 239/418; 239/429; 239/432; 239/592; 239/594; 239/597; 239/601

(58) Field of Search ..... 239/589, 592, 239/594, 597, 601, 553, 553.3, 553.5, 552, 566, 418, 429, 432

(56) References Cited

U.S. PATENT DOCUMENTS 220,006 * 9/1879 Warden ..... 239/427
2,131,977 * 10/1938 Schwalbe ..... 239/427
2,702,986 * 3/1955 Kadosch et al. ..... 239/597
2,770,501 * 11/1956 Coanda ..... 239/DIG. 7
4,504,014 3/1985 Leuning .
4,569,482 * 2/1986 Hiruma et al. ..... 239/296
5,232,164 8/1993 Resch .
5,284,554 2/1994 Datta et al. .
5,445,185 8/1995 Watanabe et al. .
5,545,073 8/1996 Kneisel et al. .
5,566,703 10/1996 Watanabe et al. .
5,679,062 10/1997 Goenka et al. .
5,815,181 9/1998 Kashino et al. .
5,836,150 11/1998 Garcia .
5,901,908 5/1999 Goenka et al. .
5,920,013 7/1999 Boardman et al. .

* cited by examiner

*Primary Examiner*—Robin O. Evans
(74) *Attorney, Agent, or Firm*—Visteon Global Technologies, Inc.

(57) ABSTRACT

A nozzle 10 having an outlet aperture 26, the outlet aperture 26 having at least one injector 40,42 which is disposed within the aperture 26 and which injects a material 17 within the aperture 26, effective to allow the material to be atomized and to be emitted from the aperture 26 at a substantially identical velocity at each point within the aperture 26.

13 Claims, 4 Drawing Sheets

NOZZLE

FIELD OF THE INVENTION

This invention relates to a nozzle and more particularly, to a nozzle which selectively emits and deposits material upon a targeted location and/or object and which causes the material to have a substantially uniform deposition concentration and impingement velocity.

BACKGROUND OF THE INVENTION

Nozzles selectively emit various types of materials, such as and without limitation a liquid material such as paint, thereby allowing the selectively emitted material to be placed or deposited upon various objects and/or targeted locations in some desired pattern and/or concentration. Particularly, the paint, or other type of liquid material, is atomized by a relatively high velocity stream of gas which traverses the generally hollow nozzle, thereby creating atomized particles or droplets of material. These atomized material particles or droplets are then selectively emitted from the exit or outlet aperture of the nozzle, along with the atomizing gas, and impinge upon and adhere to the targeted object or location. It is often times desirable to cause the material to be deposited upon the targeted object and/or location in a substantially uniform concentration (i.e., the concentration of the applied material along and/or throughout the entire material deposition region or area is substantially constant or uniform). In this manner, the deposited material forms an overall aesthetically pleasing appearance and allows for the desired and selective formation of substantially "clean", "crisp", and substantially straight edges. Moreover, it is desirable to substantially ensure that the emission velocity of the atomized material is substantially uniform and/or constant in order to allow the material emission device and/or nozzle to be placed or held at a certain distance from the targeted object and/or location, effective to cause all of the atomized material to impinge upon the targeted object and/or location at a certain substantially identical velocity without causing undesired spattering and/or non-uniform deposition concentrations.

While prior nozzles and nozzle assemblies selectively emit material and allow the selectively emitted material to be placed upon various objects and/or targeted locations (e.g., a vehicle), they do not readily provide for the deposition of substantially uniform material concentrations upon the object and/or location, do not substantially allow for the desired formation of relatively "crisp", "clean", and straight edges, and do not substantially ensure that all of the atomized material emanates from the nozzle at a substantially identical velocity.

These drawbacks are primarily due to the creation of relatively turbulent shear layers which are typically created and/or formed along the edges of the emitted gas, thereby causing the velocity of the gas, which is emitted at, through, and along the edges of the nozzle outlet aperture, to exponentially decay, thereby causing and/or creating a non-uniform velocity profile within the nozzle outlet aperture (i.e., the velocity of the gas which is emitted at and/or through the center portion of the nozzle outlet or exit aperture is substantially larger or greater than the velocity of the gas which is emitted at or along the edges of the outlet aperture).

The shear layer and its concomitant creation of a non-uniform velocity profile, similarly causes different amounts and/or quantities of the atomized material to be emitted along and through the exit or outlet and to form or create non-uniform deposition concentration regions upon the portion of the targeted object or location to which the atomized material is applied. That is, the relatively high velocity atomizing gas, which is emitted along and/or through the middle or center portion of the nozzle outlet , aperture, causes greater amounts of atomized material to be emitted along or through this middle portion of the nozzle outlet aperture, and causes more of the atomized material to be deposited upon the portion of the target object/location which receives the material through this center or middle aperture portion. The non-uniformity of the emitted atomizing gaseous material also causes the atomized material to have a nonuniform velocity (i.e., the atomized particles are not emitted from the nozzle at a substantially identical velocity and impinge upon the targeted location and/or object at different velocities).

There is therefore a need for a new and improved nozzle which allows material, such as paint, to be selectively atomized and deposited upon a targeted location and/or object; which allows for the deposited material to have a substantially uniform deposition concentration; and which allows for the formation of relatively "clean", "crisp", and straight edges; which allows the atomizing material to have a substantially uniform velocity profile along and/or throughout the material outlet or exit aperture; and which allows the atomized material to have a substantially uniform impingement velocity profile.

SUMMARY OF THE INVENTION

It is a first object of the present invention to provide a nozzle which overcomes some or all of the previously delineated disadvantages of prior nozzles and/or nozzle assemblies.

It is a second object of the present invention to provide a nozzle which overcomes some or all of the previously delineated disadvantages of prior nozzles and/or nozzle assemblies and which allows for the formation of a relatively uniform material deposition concentration upon a targeted location and/or object.

It is a third object of the present invention to provide a nozzle which overcomes some or all of the previously delineated disadvantages of prior nozzles and/or nozzle assemblies and which allows for the creation of a relatively uniform atomizing material velocity profile within and/or proximate to the nozzle outlet aperture.

It is a fourth object of the present invention to provide a nozzle which emits atomized particles of material, each of the particles having a substantially identical velocity.

According to a first aspect of the present invention, a nozzle is provided. The nozzle includes a generally hollow body having an inlet aperture which selectively receives a first material and further having an outlet aperture through which the first material is emitted from the nozzle. The nozzle further includes a relatively narrow throat portion which communicatively couples the inlet and outlet apertures and at least one injector which is resident within the outlet aperture and which selectively injects a second material into the outlet aperture, effective to allow the first material to atomize the injected second material and to allow the atomized second material to be emitted from the outlet aperture.

According to a second aspect of the present invention a method for injecting material is provided. The method includes the steps of providing an atomizing material; providing a member having an outlet aperture; forming a constricted portion within the member; causing the atomizing material to traverse the constricted portion of the member and to enter the outlet aperture; injecting the material into the outlet aperture, thereby causing the material to be atomized by the atomizing material and to be emitted from the member.

These and other features, aspects, and advantages of the present invention will become apparent from a reading of the following detailed description of the preferred embodiment of the invention in combination with the accompanying drawings.

DETAILED DESCRIPTION OF THE PREFERRED EMBODIMENT OF THE INVENTION

Figure 1:
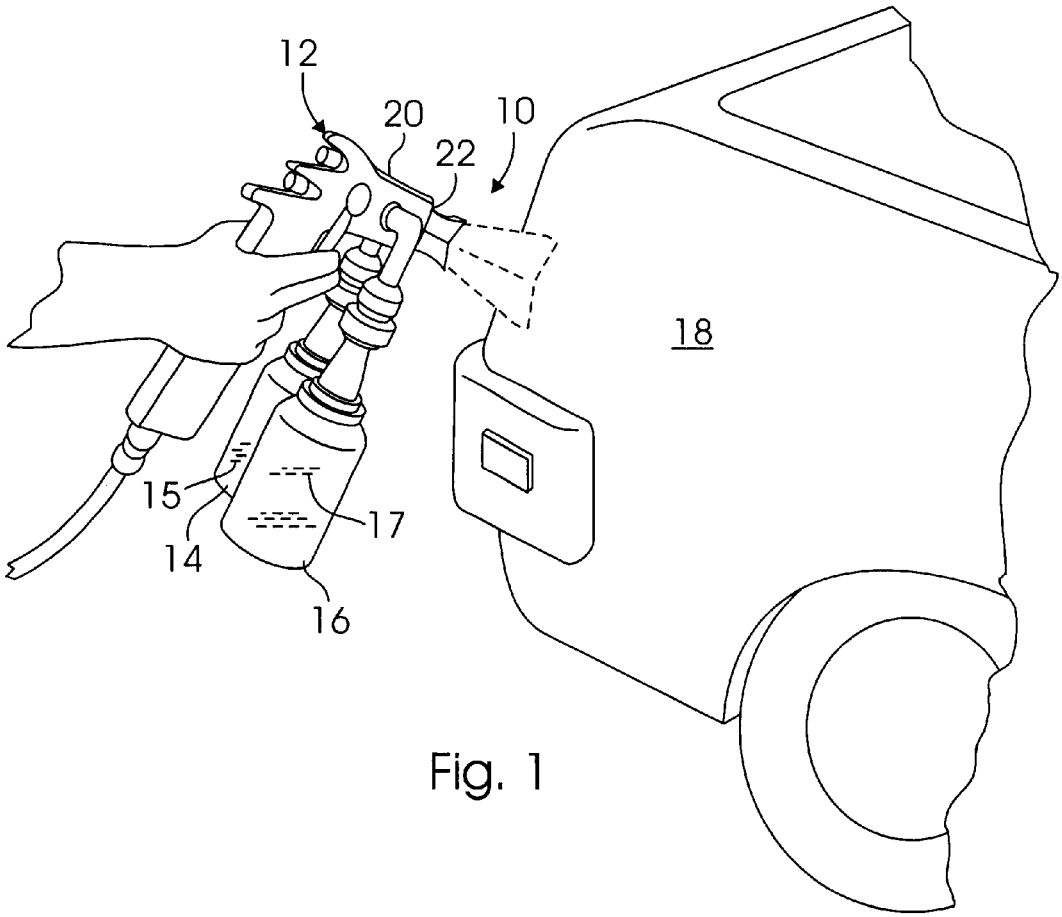
FIG. 1 is a perspective view of a spray gun operatively incorporating a nozzle which is made in accordance with the teachings of the preferred embodiment of the invention.

Referring now to FIGS. 1–4, there is shown a nozzle 10, which is made in accordance with the teachings of the preferred embodiment of the invention. Particularly, as best shown in FIG. 1, nozzle 10 is adapted to be used in combination with a hand-held spray or paint gun, or other type of conventional and/or commercially available material emitting device 12.

Figure 2:
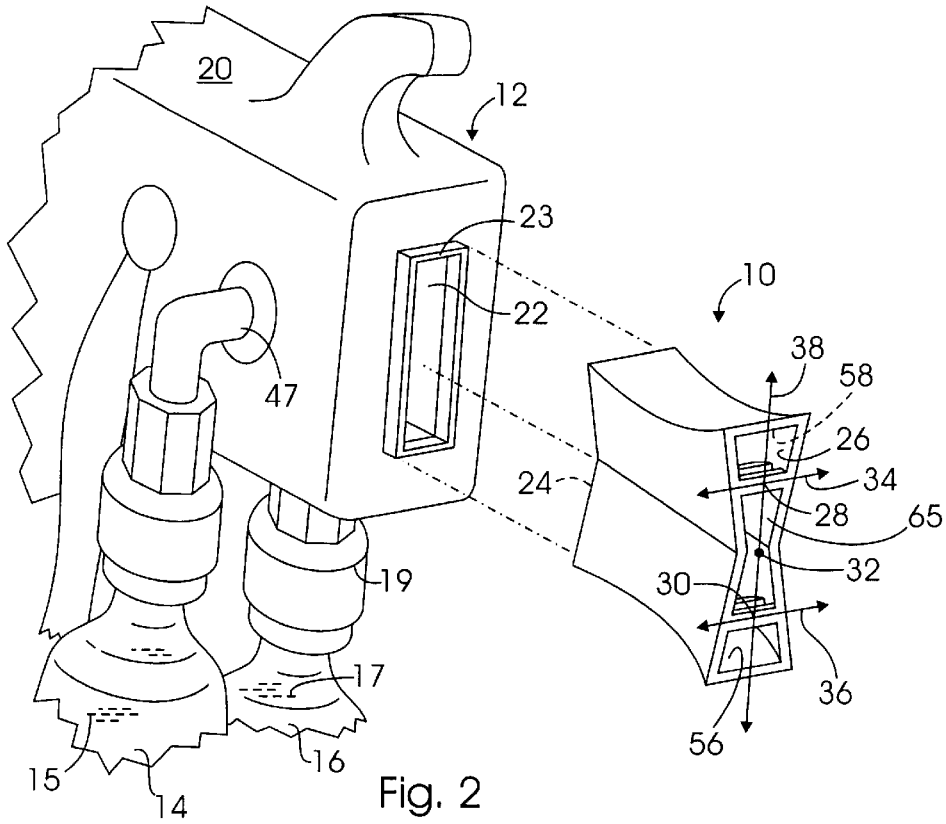
FIG. 2 is a perspective enlarged fragmented and unassembled view of the spray gun which is shown in FIG. 1.

As shown, device 12 has a source or a canister 14 of a first material 15, such as liquid or paint, which is desired to be selectively deposited upon a targeted location and/or object, such as a vehicle 18, and a second source or canister 16 of a second material 17, which selectively and operatively atomizes the first material 15 before the first material 15 is deposited upon the targeted object or location 18. The device 12 typically includes a generally hollow body 20 which forms and/or includes an outlet aperture 22 which is best shown in FIG. 2 and which, in one non-limiting embodiment, includes an integrally formed and elevated or flange portion 23 which substantially surrounds and generally conforms to the shape of the outlet aperture 22. It should be appreciated that the outlet aperture 22 may be of any desired and/or conventional shape or spatial configuration and that, in the most preferred embodiment of the invention, aperture 22 comprises a substantial rectangular shape.

Nozzle 10 is generally hollow and forms and/or includes an inlet aperture 24 and an outlet aperture 26, which are communicatively coupled. Nozzle 10 is further, in one non-limiting embodiment, adapted to be removably and frictionally secured to the flange portion 23 and, when secured, cause apertures 24 and 22 to be in a communicating relationship. It should be appreciated that nozzle 10 may be of substantially any desired shape, including a shape which is substantially identical to the aperture 22, and that the shapes which are shown in the various attached FIGS. 1–8 are for illustration purposes only and should not limit the invention in any manner whatsoever. Canister 16 communicates with the inlet aperture 22, by use of tube or conduit 19 and the emitter 12 selectively injects, in a conventional manner, atomizing gaseous material 17 from the canister 16, into the body 20, through the communicating apertures 22, 24, and into the nozzle 10.

Figure 3:
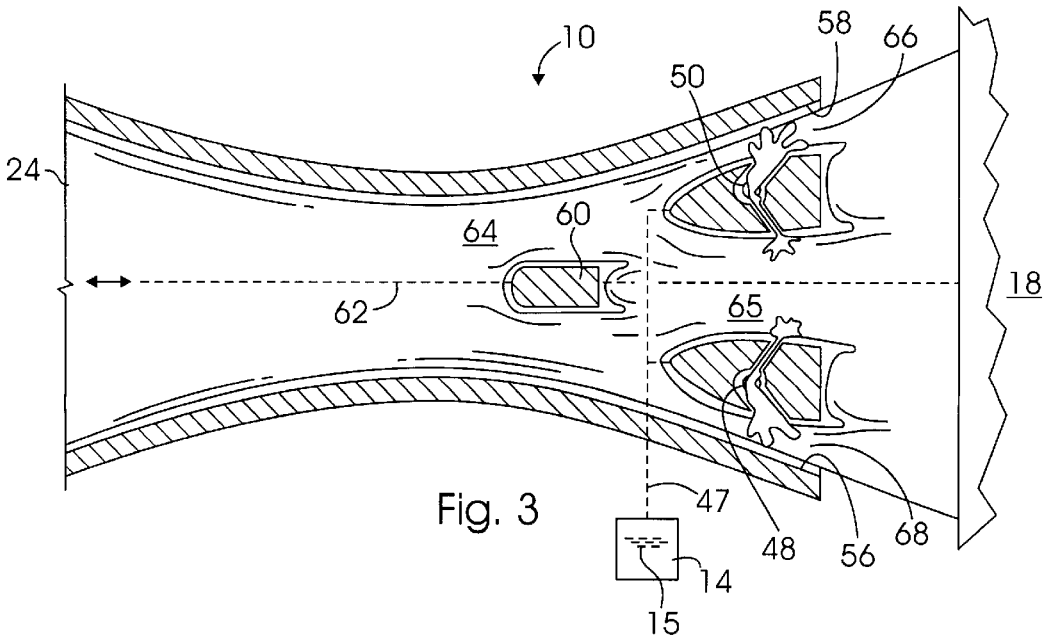
FIG. 3 is side view of the nozzle which is shown in FIGS. 1 and 2.
Figure 4:
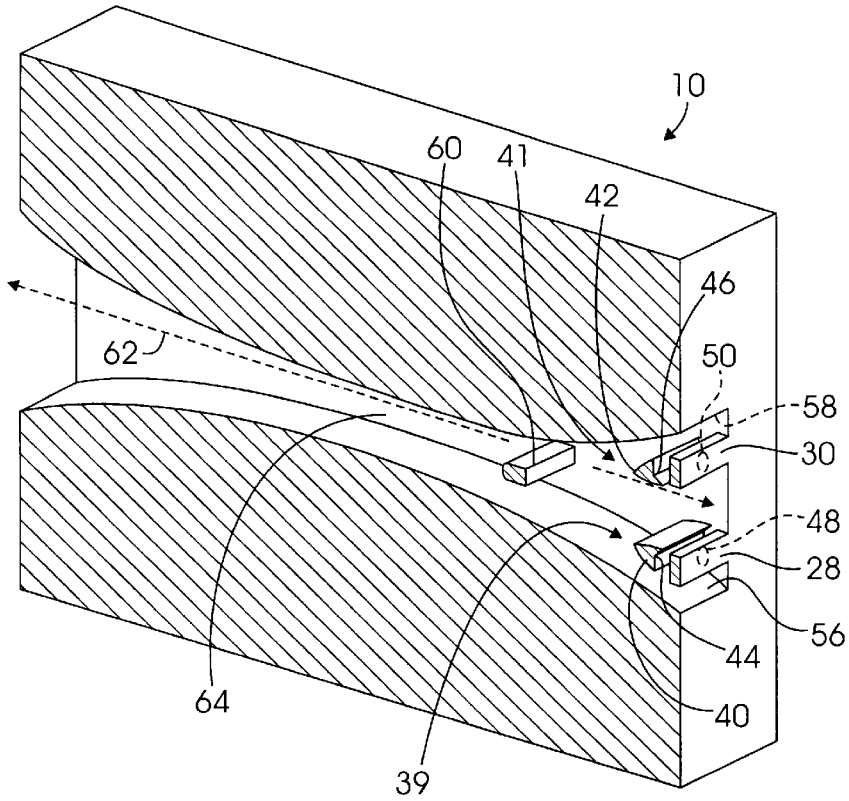
FIG. 4 is a perspective sectional view of the nozzle which is shown in FIG. 3.

As shown best in FIGS. 2, 3, and 4, nozzle 10 includes a pair of substantially identical and generally rectangular wall members 28, 30 which are equidistantly positioned from the center point 32 of the aperture 26 and which each have a respective longitudinal axis of symmetry 34, 36 which is substantially perpendicular to the longitudinal axis of symmetry 38 of the aperture 26. Nozzle 10 further includes a pair of substantially identical struts 39, 41. Each strut 39, 41 includes a substantially identical "v"-shaped member 40, 42 having a respective and substantially cupped shaped or grooved portion 44, 46 which respectively cooperate with walls 28, 30 to secure tubes or conduits 48, 50 within the outlet aperture 26. Each tube or conduit 48, 50 is communicatively and physically coupled to the tube 47 and are positioned at opposite edges or ends of the aperture 26. In this manner, the material 15 which is contained within the canister 14 is injected, in a conventional manner by device 12, into the tubes 48, 50 and into outlet aperture 26, thereby allowing the injected material 15 to be atomized by the gaseous material 17 which emanates from the canister 16. In a second embodiment of the invention, which is shown best in FIG. 7, the struts 39, 41 actually protrude from the outlet aperture 26.

The injection of the material 15 within the nozzle outlet aperture 26 increases the uniformity of the deposition concentration by reducing the velocity disparity of the atomized particles (e.g., by reducing the distance that material 15 must travel within the nozzle 10, the velocity gradient or velocity disparity of the atomized material 15 within the outlet aperture 26 is greatly reduced). Further, tubes 48, 50 may be disposed in the manner shown best in FIGS. 3 and 4, in which material 15 is injected toward the edges 56, 58 of the outlet aperture 26, thereby increasing the amount of material 15 which is provided to the edge regions or edge portions 56, 58 of the aperture 26 through which the atomizing material 17 relatively slowly travels. The injection of the material 15 within and/or outside of aperture 26 also substantially prevents "spits" from occurring and substantially reduces "film" type build-up within the nozzle 10. In one non-limiting embodiment of the invention, a substantially large amount of liquid or material 15 is injected or placed towards walls 56, 58 then into the center or middle of aperture 26, thereby producing a relatively more uniform liquid concentration profile "downstream" (i.e. within aperture 26) of the nozzle 10 and allowing the material 15 to be deposited upon object 18 in a substantially uniform manner.

In a further non-limiting embodiment, which is shown best in FIG. 3, one or more "obstruction" members 60 my be selectively placed along the longitudinal axis of symmetry 62 of the nozzle 10 (i.e., along the center flow portion), thereby causing the velocity of the gaseous material flowing through the constricted center or throat portion 64 to slow or decrease, thereby causing the velocity of the emitted gas, within or through aperture 26, to be substantially uniform. The constricted throat portion, by itself, also reduces the velocity of the relatively high speed or velocity material 17 within the central portion of nozzle 10.

Further, the nozzle outlet aperture 26 may be formed and/or created having a relatively constricted central portion 65 and relatively wide areas or portions 66, 68. In this manner, the relatively "fast" or high velocity gaseous portion traversing the center 65 of the aperture 26 is slowed, thereby further reducing the non-uniformity of the gas velocity profile. It should be realized that the use of the struts 39, 42, obstructing member 60, constricted throat portion 64, and "hour glass" shaped aperture 26, may be independently applied and/or used within the nozzle 10.

Figure 5:
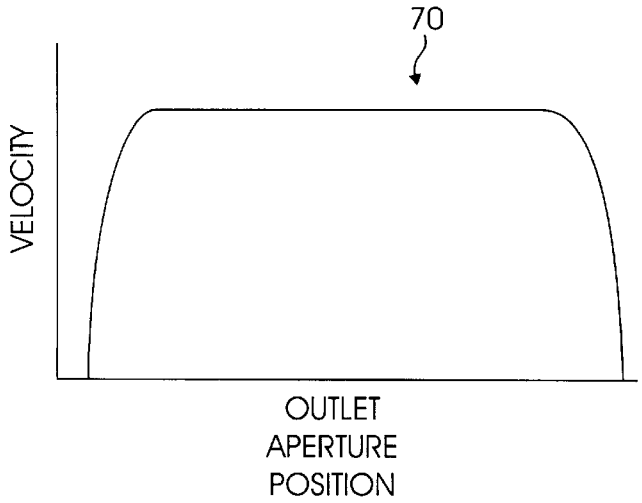
FIG. 5 is a graph illustrating a typical deposition material concentration profile created by the nozzle which is shown in FIGS. 1–4.
Figure 6:
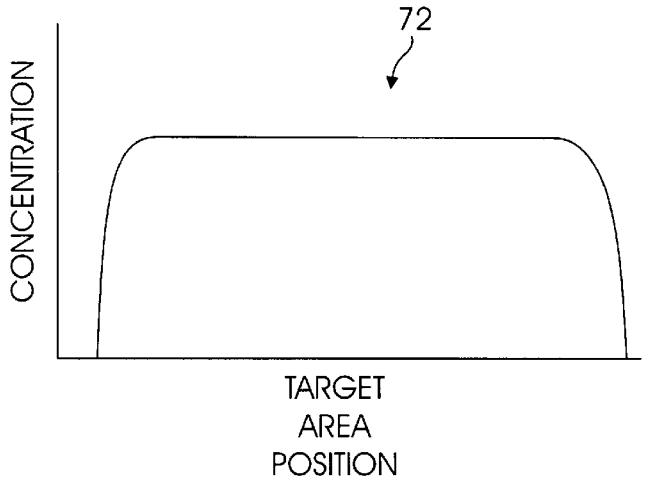
FIG. 6 is a graph illustrating a typical atomizing material velocity profile created within the outlet aperture of the nozzle which is shown in FIGS. 1–4.
Figure 7:
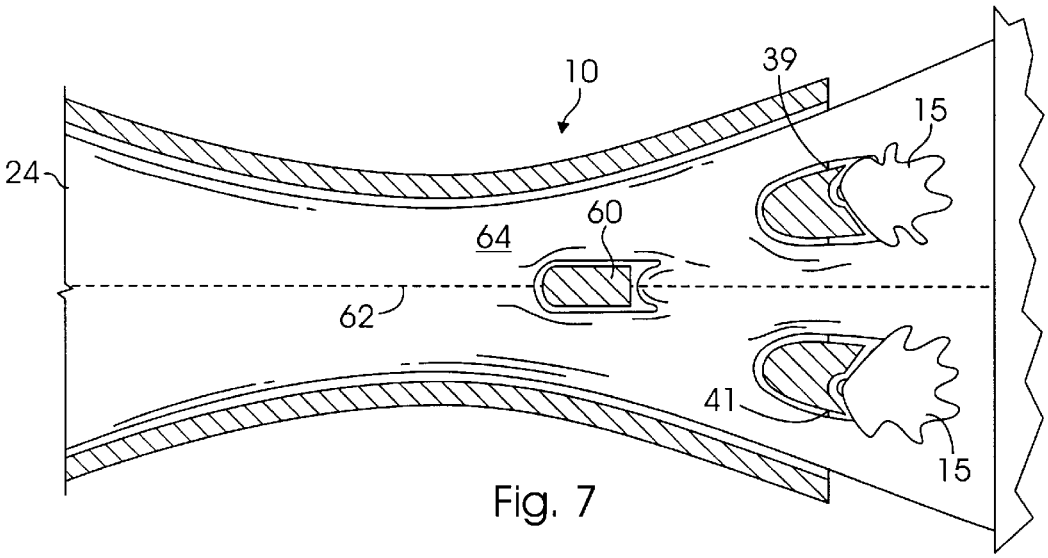
FIG. 7 is a side view of a nozzle which is made in accordance with the teachings of a second embodiment of the invention.

As best shown in graphs 70, 72 which are respectively shown in FIGS. 5 and 6, the use of such outlet aperture injection strut members 39, 41, member 60, the "hour glass" shaped aperture, allows the velocity of the emitted material within and/or at a relatively small distance from the outlet aperture 26 to be relatively constant. Similarly, the concentration of material placed upon the targeted location and/or object 18 is substantially uniform.

Figure 8:
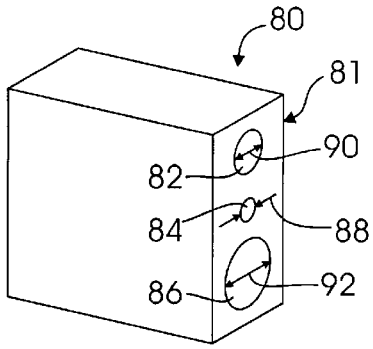
FIG. 8 is a perspective view of a nozzle which is made in accordance with the teachings of a third embodiment of the invention.

In yet a third embodiment of the invention, as best shown in FIG. 8, a nozzle 80 having an outlet aperture 81 having several circular distinct outlet portions such as 82–86, is formed. The diameter 88 of central portion 84 is substantially smaller than the respective diameter 90, 92 of the edge portions 82, 86 in order to slow the velocity or speed of the traversing gas within the central portion of the nozzle 80. This embodiment may be used in combination with member 60 and struts 39, 41 to further provide a more uniform outlet aperture velocity and/or material concentration profile.

It is to be understood that the invention is not limited to the exact construction and method which has been previously described, but that various changes and modifications may be made without departing from the spirit and the scope of the invention.

What is claimed is:

1. A nozzle having a constricted throat portion which is communicatively coupled to an outlet aperture, said nozzle further having at least one injector, which has a first substantially rectangular wall member and a "V"-shaped member having a cup-shaped portion which cooperates with said wall member to form a reception slot, which is positioned within said outlet aperture, and which selectively injects material into the outlet aperture.

2. The nozzle of claim 1 wherein said outlet aperture has a central portion and first and second end portions and wherein said material is injected toward said first and second end portions.

3. The nozzle of claim 2 wherein said outlet aperture has a substantial hour glass shape.

4. The nozzle of claim 2 wherein said outlet aperture has a substantial rectangular shape.

5. The nozzle of claim 2 wherein said central portion of said outlet aperture is constricted.

6. The nozzle of claim 3 including an obstruction member which is positioned with said constricted throat portion.

7. The nozzle of claim 1 wherein said material comprises paint.

8. The nozzle of claim 1 wherein said nozzle further comprises a tube which is coupled to a canister of said material and which is disposed within said reception slot.

9. A nozzle having an inlet aperture which selectively receives material and an outlet aperture which is communicatively coupled to said inlet aperture and which receives said material, said outlet aperture including a central portion and an end portion through which a first and a second portion of said material are respectively emitted at respectively and substantially identical velocities.

10. The nozzle of claim 9 where said outlet aperture has a substantially hour glass shape.

11. The nozzle of claim 9 wherein said nozzle further includes at least one injector which injects a second material into said outlet aperture.

12. The nozzle of claim 11 wherein said second material comprises paint.

13. The nozzle of claim 12 wherein said material comprises gas.

* * * * *